US005146823A

United States Patent [19]

Holmes

[11] Patent Number: 5,146,823

[45] Date of Patent: Sep. 15, 1992

[54] METHOD AND APPARATUS FOR PRECISION CUTTING OF CORRUGATED PAPERBOARD SPECIMENS

[75] Inventor: William C. Holmes, South Harpswell, Me.

[73] Assignee: Emerson Apparatus Co., Inc., Portland, Me.

[21] Appl. No.: 787,555

[22] Filed: Nov. 4, 1991

[51] Int. Cl.[5] ..... B26D 1/04; B26D 7/01

[52] U.S. Cl. ..... 83/56; 83/451; 83/485; 83/614; 83/929; 83/955; 83/468.2; 83/468.6; 83/471.2; 269/47

[58] Field of Search ..... 83/13, 36, 56, 451, 83/468.6, 468.1, 468.2, 471.2, 485, 614, 929, 955; 269/47, 48, 49

[56] References Cited

U.S. PATENT DOCUMENTS 1,732,148 10/1929 Barrett ..... 83/614
4,131,046 12/1978 Strohmeyer ..... 83/471.2
4,884,484 12/1989 Bakermans et al. ..... 83/451

*Primary Examiner*—Hien H. Phan
*Attorney, Agent, or Firm*—Frederick R. Cantor

[57] ABSTRACT

A method and apparatus for the precision cutting of corrugated paperboard panels into rectangular test specimens, having shapes of predetermined size. A reference rod is inserted through a selected flute in the corrugated paperboard panel, prior to the first cutting operation on the raw panel. The reference rod is then placed in a specific location on the cutting table surface, so that the internal flutes in the raw panel are oriented at a specific angle to the cutting plane of the cutter mechanism. This ensures that the first edge formed on the raw panel has a precise orientation relative to the panel flutes, such that the final precision cut panel specimen can be used as a test specimen for performing edge compression tests, and other tests, that are reproducible, and representative of the characteristics of the corrugated paperboard panel structure.

14 Claims, 2 Drawing Sheets

METHOD AND APPARATUS FOR PRECISION CUTTING OF CORRUGATED PAPERBOARD SPECIMENS

BACKGROUND OF THE INVENTION

The present invention relates to a method and apparatus for the precision cutting of corrugated paperboard panels into specimens having square, or other rectangular, shapes of predetermined size, e.g., four inches on a side, etc. The precision, cut to size specimens are subsequently used as test specimens for various measurements, e.g., bending tests, column strength tests, edge compression tests, flat crush tests, and adhesion tests.

Apparatus has previously been developed for cutting corrugated paperboard panels into square or rectangular configurations for subsequent use as test specimens in standardized testing of the paperboard material. The conventional cutting apparatus can take various forms. One known cutting apparatus comprises a horizontal table or platform having a flat upper surface adapted to receive the corrugated paperboard panel flatwise thereon, and an elongated knife blade swingably connected to the table for downward motion along one edge of the table. A handle extending from the elongated knife is pulled downwardly so that the knife blade slices through the paperboard panel in a downward arc, to thereby form a straight edge on the panel. The panel is then repositioned on the table, and the cutting process is repeated to form four straight edges on the paperboard panel.

The above table is equipped with an upstanding linear abutment, or backstop, oriented at right angles to the cutting plane of the knife blade, whereby the paperboard panel can be positioned with a cut straight edge engaged against the abutment, while the various cuts are being made in the panel. The abutment, or backstop, permits successive cuts to be made at right angles to one another, so that the final test specimen has a rectangular, usually square, or other rectangular, configuration.

The cutting table, or platform, may have a slidably adjustable T-square, that includes a horizontal upstanding straight edge extending parallel to the cutting plane of the vertically-oriented knife blade. The horizontal spacing between the upstanding straight edge and the blade cutting plane, can be varied or changed to permit variation in the size of the cut specimen, or test specimen panel. As previously noted, the cut test specimen will usually have a square, or other rectangular, shape. Typically, the cut square or rectangular specimen, will vary in size from an upper limit of about six inches along each edge, to a lower limit of about one inch along each edge. The size of the cut test specimen is determined by tests to be performed, and effectuated by the settings of the slidable T-square, or, more properly, an L-square.

The cutting blade can be arranged for vertical motion along an edge of the panel support table, as previously described. However, a vertically moving cutter blade does not achieve an optimum cutting action, since it exerts a downward pressure on the upper surface of the paperboard panel. The cut edge may thus be slightly depressed, or squashed, especially if the cutter blade is slightly worn, in which case, there is a greater cutter blade edge area in contact with the paperboard surface.

As an alternative, and as practiced in the present invention, the cutter blade can be made to move horizontally through the paperboard panel parallel to the panel faces, i.e., the cutting blade can be arranged to move horizontally along the table surface so as to produce essentially no deformation of the panel face. In such a case, the lower end of the cutter blade extends into a slot in the table surface, while the cutting edge of the cutter blade extends generally vertically, so that the cutter blade attacks the edge of the paperboard panel along a horizontal action line.

The cutter mechanism can be operated manually, or with a power actuated mechanism, e.g., a fluid cylinder. In one known apparatus, an air-operated fluid cylinder is supported for horizontal motion across the table surface. A cutter blade is carried by the movable portion of the cylinder, such that pressurization of the cylinder sends the cutter blade across the table to form a cut straight edge on the corrugated paperboard panel. Reverse motion of the cylinder returns the cutter blade to its original position ready for the next cutting cycle, after repositionment of the paperboard panel.

One major and serious disadvantage of all existing prior art cutting apparatus, is the fact that there is no mechanism for precisely determining, and effecting, the precise orientations of the test specimen panel cut edges, relative to the internal flutes in the corrugated paperboard panels, prior to making the cuts. The term, "flutes," is herein used to mean the linear passages, or 'tunnels,' formed within the corrugated paperboard panel, by the corrugated internal liner sheet.

Typically, the corrugated paperboard panels have two flat spaced-apart outer sheets, and an internal corrugated liner sheet. The corrugations, or undulations, defining the flutes, space the two outer sheets apart, and determine the overall thickness of the panel. Typically the paperboard panel will have a thickness of about one-eighth of an inch, such that each undulation has a transverse dimension slightly less than about one-eighth of an inch.

The square or rectangular test panels are designed to be subjected to several different tests, including an extremely important edgewise compression test, which should be performed 'perfectly', or precisely, parallel, to the direction of the internal flutes, or, alternately, 'perfectly' normal to the flute direction. In order to produce reproducible, or duplicate, test results on similarly constructed paperboard panels, it is necessary that the square or rectangular test specimen panels be uniformly and precisely cut, or formed, so that two of the test specimen panel edges are always precisely parallel to the flutes, and the other two specimen panel edges are always precisely normal to the flutes.

The hollow, internal flutes are located within the corrugated paperboard panels, so that the flute direction is not always readily determined by a visual inspection of the uncut corrugated paperboard panel. However, it is possible to form a panel edge running "approximately" parallel to the flute direction, by a trial-and-error process, wherein the edge of the test specimen, or sample, is inspected after the first cut, to determine the approximate extent of the deviation from parallelism.

However, such visual trial-and-error inspection, involves an inspection of the corrugated panel sheet edges that are in semi-concealed locations between the outer facing sheets of the corrugated paperboard panel. Therefore, the observer is never quite certain, from a visual inspection, whether or not, the first cut is, in fact, exactly, or precisely, parallel to the internal flute direction. In any event, such visual inspections, as flawed as they are, also require a lengthy amount of time, and a certain degree of skill, on the part of the operator.

It is possible to pry apart the edges of the outer facing sheets of the paperboard panel, in order to better see the directions of the flutes. However, such an operation destroys the integrity of the panel edge, and thus renders the panel essentially useless for edge compression strength testing, and other test measuring purposes.

There is a clear and strong need for a corrugated paperboard panel cutting method and apparatus, wherein the first cut of the panel test specimen, is made either precisely parallel, or precisely normal, to the flute direction, such that the final square, or other rectangular, test speimen panel, has two edges running precisely normal to the flute direction and two edges running precisely parallel to the flute direction. If the test specimen's first cut edge can have the desired precise orientation relative to the flute direction, the remaining three test specimen edges can automatically be made to have the necessary orientations, e.g., by using T-square cutting guide surfaces properly oriented to the cutter blade plane. The present invention is directed to a method and apparatus for achieving either the desired parallelism, or normalcy, between the test specimen's first cut edge and the flute direction, as well as subsequent cut edges.

An additional problem inherent in conventional cutter blade constructions, which has been elegantly solved by the present invention, is the premature dulling of the cutter blade. With conventional arrangements, the same zone of the cutter blade's cutting edge is used continually for each cutting cycle. The cutting pressure is repetitively applied to a relatively small localized area of the cutter blade edge, so that the cutter blade becomes dull after only a relatively few cutting cycles, necessitating frequency replacement of the cutter blade.

Cutter blade replacement requires time, and also involves potential danger to the operator, because the cutter blade edge is extremely sharp, especially the new replacement cutter blade. Manual handling of the cutter blade during blade removal or installation can, therefore, cause serious injury to the operator.

The present invention also seeks, in part, to provide a cutter blade construction, wherein, different zones of the cutter blade's cutting edge are used for cutting purposes during successive cutting cycles. Wear on the cutter blade is, therefore, distributed over a longer cutting edge area, such that cutter blade replacement is less frequent, compared to prior art arrangements.

SUMMARY OF THE INVENTION

An object of the present invention is to provide a method and apparatus for the precision cutting of corrugated paperboard panels into test specimens, having square, or other rectangular, shapes of predetermined size.

A reference rod is inserted and extended through one flute of the paperboard panel specimen, prior to the first cut being made on the specimen. The reference rod is extended completely through the fluted passage of the panel specimen, so that opposite ends of the rod are exposed. The exposed ends of the reference rod are then anchored to the cutting table surface, so that the reference rod is precisely oriented, relative to the cutting plane of the cutter blade.

In one embodiment of the present invention, the reference rod is oriented parallel to the cutting plane of the cutter blade. In a second embodiment of the present invention, the reference rod is oriented so that it is normal to the cutter blade cutting plane. With either embodiment, the first cut on the corrugated paperboard panel specimen, has a precisely specific orientation relative to the flute orientation in the specimen. The remaining cuts in the specimen are then made, using the first edge cut as a reference.

By using the method and apparatus of the present invention, it is possible to form square, or rectangular, corrugated paperboard panel test specimens, having two edges precisely parallel to the panel flutes, and two other edges precisely normal to the panel flutes. The method and apparatus of the present invention achieves a high degree of accuracy, or precision, without any trial-and-error operations, and with minimal scrap losses or spoiled test specimens. Additionally, no special skill is required on the part of the operator.

As another aspect of the present invention, the cutter apparatus comprises a circular cutter blade designed so that the entire edge of the cutter blade is utilized for cutting purposes. The cutter blade is designed to be in a non-rotating mode during the cutting stroke, but, to be in a rotating mode during the return, or reset stroke. During a given cutting cycle, a localized edge area of the cutter blade will randomly advance into the workpiece, i.e., a corrugated paperboard panel or specimen, to perform a cutting operation. During the next cutting cycle, a different localized edge area of the cutter blade will randomly register with the workpiece. Over time, different zones of the circular cutter blade edge will be used, on a random basis, such that the entire cutter blade edge surface will be effectively utilized.

In one specific embodiment of the present invention, the circular cutting blade will be oriented in a vertical plane on one end of a horizontal shaft, that is mounted in a support carriage, via a one-way overrunning clutch. The support carriage is movable horizontally over, or across, a table surface that is used to support a corrugated paperboard panel or specimen flatwise on the table surface.

During movement of the support carriage in one direction, the edge of the cutter blade slices through the corrugated paperboard panel with a shearing action parallel to the major plane of the panel. In this operation, the overrunning clutch causes the cutter blade to be in a non-rotating mode during the cutting stroke. During reverse movement of the support carriage, the cutter blade is returned along the same cutting path, to randomly reset the cutter blade for another cutting cycle. At this time, the overrunning clutch permits the cutter blade to be in a freely rotating mode, as determined by frictional engagement between the edge of the panel and the side surface of the cutter blade.

The use of a one-way overrunning clutch between the cutter support shaft and the carriage, permits the cutter blade to have different random positions of rotational adjustment during different cutting cycles. On a statistical basis, essentially the entire edge of the cutter blade will be effectively available for cutting purposes, even though only a minor portion of the cutting blade edge is used during any one cutting cycle. The present invention additionally prolongs the cutter blade life and minimizes the need for cutter blade replacement.

In summary, and in accordance with the above discussion, the foregoing objectives are achieved in the following embodiments.

1. An apparatus for precision cutting of corrugated paperboard panel specimens into rectangular shapes of predetermined size, wherein said corrugated specimens have parallel internal flutes extending across the entire specimen face area; said apparatus comprising a table means, defining a flat specimen support surface; a linear abutment means projecting upwardly from said support surface to receive an edge of said specimen when said specimen is lying flat on said support surface; a cutter means mounted for linear motion over said table means on a linear path normal to said abutment means; a reference rod extendable linearly through a flute of said specimen, so that opposite ends thereof project beyond said specimen edges; and anchorage means on said table means for engagement with the projecting ends of said reference rod, whereby said specimen is temporarily supported on said support surface, with its flutes precisely oriented relative to the pathline for said cutter means.

2. The apparatus as described in paragraph 1, wherein said anchorage means is located on said table means, so that said engaged reference rod is parallel to said pathline for said cutter means.

3. The apparatus as described in paragraph 1, wherein said anchorage means is located on said table means, so that said engaged reference rod is parallel to said linear abutment means.

4. The apparatus as described in paragraph 1, wherein said anchorage means comprises two separate anchorage devices, said devices individually engageable with said projecting ends of said reference rod; each said anchorage device being mounted on said table means for movement between an operating position projecting above said specimen support surface and a depressed non-operating position retracted into said table means.

5. The apparatus as described in paragraph 4, wherein each said anchorage device comprises a magnet.

6. The apparatus as described in paragraph 1, wherein said cutter means comprises a carriage mounted for linear reciprocating movement over said specimen support surface, and a circular cutter blade oriented in a vertical plane on said carriage, so that said linear movement of said carriage causes an edge of said cutter blade to exert a shearing action on said specimen lying on said specimen support surface.

7. The apparatus as described in paragraph 6, and further comprising means supporting said circular cutter blade for rotational adjustments around its circular axis, whereby different unworn edge areas of said cutter blade can be presented to the specimen.

8. The apparatus as described in paragraph 7, wherein said rotational adjustment means comprises a one way overrunning clutch that prevents said circular cutting blade from rotating while said cutter blade is performing a cutting operation on said specimen.

9. The apparatus as described in paragraph 1, and further comprising a linear guide overrunning said table means to define a guidance axis; said cutter means comprising a carriage slidably mounted on said linear guide for reciprocating movement along said guidance axis, a horizontal rotary shaft extending through said carriage normal to said guidance axis, a circular cutter blade mounted on one end of said shaft so that said cutter blade is in a vertical plane parallel to said guidance axis, and a one-way overrunning clutch mounted in said carriage to exert a one-way clutch action on said shaft, whereby during movement of said carriage in one direction, an edge of said cutter blade cuts into said specimen, while said clutch prevents said cutter blade from rotating, and, during movement of said carriage in the opposite direction, frictional drag of said specimen on said cutter blade causes said cutter blade and said shaft to rotate without interference from said one-way clutch.

10. A method for precision cutting of corrugated paperboard panel specimens into rectangular shapes of predetermined size, wherein said corrugated specimens have parallel internal flutes extending across the entire specimen face area: said method comprising the steps of extending a linear reference rod through a flute of said specimen so that opposite ends thereof project beyond said specimen's end edges; anchoring the opposite ends of said reference rod at specific points on a table surface, with said specimen lying flat on said surface; moving a cutter means linearly across said table surface, along a predetermined pathline related to the direction taken by said reference rod, whereby said cutter means forms a first straight edge on said specimen; positioning said specimen on said table surface, with said first edge engaged against a linear abutment extending normal to said cutter means pathline; and moving said cutter means a second time to form a second straight edge oriented at a right angle to said first straight edge.

11. The method as described in paragraph 10, wherein said step of anchoring the ends of said reference rod to said table surface is carried out so that said anchored reference rod is parallel to said cutter means pathline.

12. The method as described in paragraph 10, wherein said step of anchoring the ends of the reference rod to the table surface is carried out so that said anchored reference rod is normal to said cutter means pathline.

13. The method as described in paragraph 10, wherein said step of moving said cutter means along said predetermined pathline, is carried out with a vertically-oriented circular cutter blade.

14. The method as described in paragraph 13, wherein said circular cutter blade is controlled, so that it is in a non-rotating mode while it is forming a straight edge on said specimen, said cutter blade being in a rotating mode while it is being reset for the next edge-forming operation, whereby different unworn edge areas of said cutter blade can be presented to said specimen.

DESCRIPTION OF THE PREFERRED EMBODIMENTS OF THE PRESENT INVENTION

Figure 1:
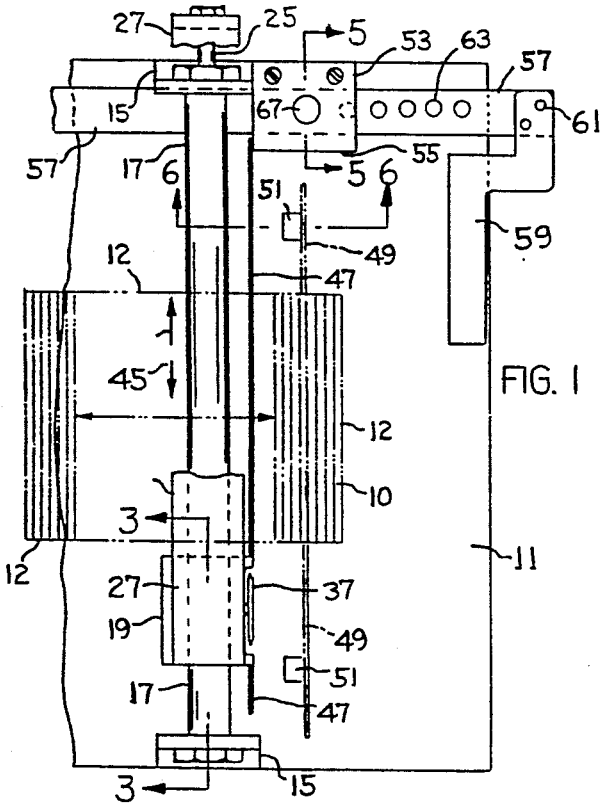
FIG. 1, is a fragmentary top plan view, of an apparatus embodying the present invention.

FIG. 1, is a fragmentary top plan view, of an apparatus embodying the present invention.

Figure 2:
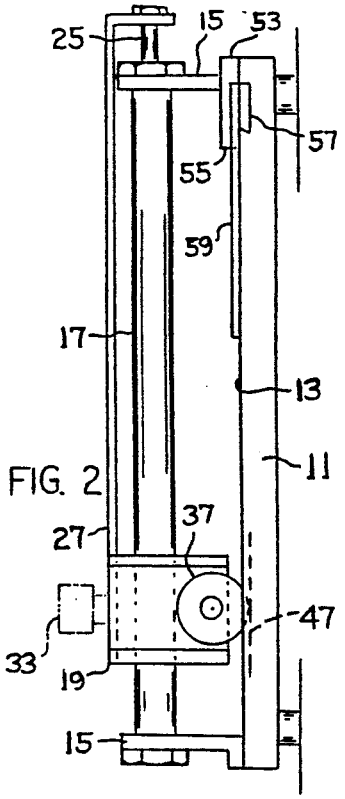
FIG. 2, is a side elevational view, of the apparatus shown in FIG. 1.

FIG. 2, is a side elevational view, of the apparatus shown in FIG. 1.

FIGS. 1 and 2, illustrate an apparatus of the present invention, designed to facilitate the rapid and precise cutting of corrugated paperboard panel specimens, into test specimens, having preferably square, or other rectangular, shapes of predetermined size, e.g., six inches on each edge or three inches on each edge, etc. It should be noted that the raw, or uncut segment of paperboard panel, may be referred to herein as a specimen, a panel, or a panel specimen. Further, the fully cut, or partially cut panel specimen, may be referred to as a test specimen, or specimen. The same apparatus can be utilized for precise cutting of a range of different size square, or other rectangular, test specimens. Simple adjustments need to be performed, in order to change from one size work product, or workpiece, to another size work product, or workpiece. In FIG. 1, a raw, uncut corrugated paperboard panel specimen is shown in phantom, and designated by reference numeral 10. The internal corrugations, or flutes, in the panel specimen 10, are indicated by the closely spaced parallel lines, within the space circumscribed by the panel edges 12.

The apparatus shown in FIGS. 1 and 2, further comprises a horizontal work table 11, having a flat, upwardly-facing, support surface 13, for receiving the raw, uncut corrugated paperboard panel specimen 10, in flatwise relationship. Within limits, the raw, uncut corrugated paperboard panel 10, can be any size larger than the final dimensions of the square, or other rectangular, test specimen panel, formed by the cutting operation.

Two upstanding angle iron supports 15, are secured to work table 11, for supporting a cylindrical linear guide 17, for a movable carriage 19. Typically, linear guide 17 can be a hollow cylindrical tube having a length of about eighteen inches. Carriage 19, will then, in practice, have a horizontal stroke length of about thirteen inches. Opposite ends of tubular linear guide 17 are threaded to receive nuts 20, whereby, the tubular linear guide 17 is fixedly secured to upstanding supports 15, in the space above table 11.

Figure 3:
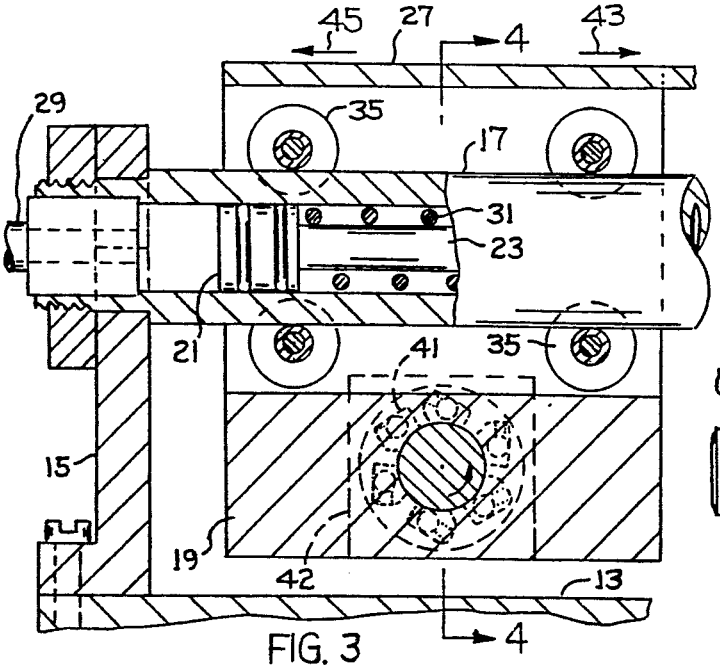
FIG. 3, is an enlarged fragmentary sectional view, taken along line 3—3, in FIG. 1.

FIG. 3, is an enlarged fragmentary sectional view, taken along line 3—3, in FIG. 1.

Carriage 19, may be moved back and forth on linear guide 17, manually, or, if preferred, by a power actuator. As illustratively shown in FIGS. 1 through 3, linear guide 17, is the cylinder portion of a fluid cylinder actuator for the carriage 19. A piston 21, is slidably arranged within cylinder-like linear guide 17, for longitudinal movement. An associated piston rod 23, extends from the piston 21 through the cylinder linear guide 17, so that its outer end 25, as shown in FIG. 2, is attached to the downturned end of a force-transmitter bar 27. The bar 27, extends horizontally along, or above, cylinder guide 17, to a fixed connection with carriage 19.

As shown generally in FIG. 3, a pressure fluid, which may be either a gas or liquid, is introduced into one end of cylinder guide 17, through a fluid line 29, whereby the piston 21 and rod 23, are moved in one direction, thereby driving carriage 19 on a cutting stroke. Withdrawal of the pressure fluid from the cylinder 17 through line 29, in reverse flow, enables an internal coil spring 31, to return piston 21 to its starting position, ready for another cutting cycle. Conventional pushbutton-operated valve means, not shown herein, may be used to control the flow of pressure fluid into, or out of, cylinder guide 17.

The drawings show a carriage actuator that comprises a single acting fluid cylinder with a coil spring return. However, a double acting cylinder could be used as an alternative. Also, carriage 19 could be moved manually, in which case, tubular guide 17 would be a simple rail structure, i.e., not part of a fluid cylinder. The manual actuator could be a simple manual knob attached to the upper face of carriage 19. Such a manual knob is shown in FIG. 2, in phantom as 33.

Figure 4:
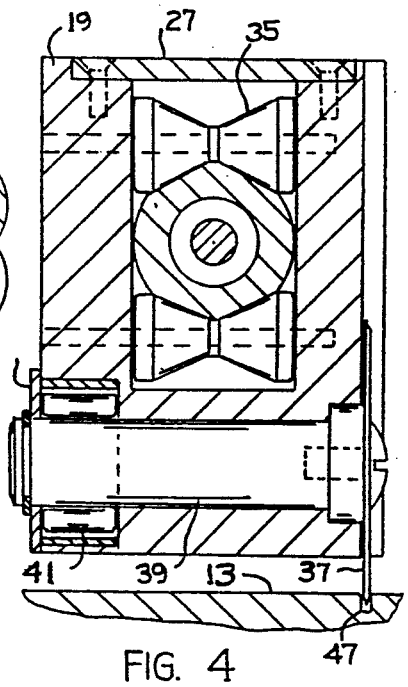
FIG. 4, is a sectional view, taken along line 4—4, in FIG. 3.

FIG. 4 is a sectional view, taken along line 4—4, in FIG. 3.

Carriage 19, can be suspended on linear guide 17, by means of four rollers 35, as shown in FIG. 3. The exact carriage suspension mechanism can take various forms. The carriage space below the suspension mechanism, is used for supporting a circular cutter blade 37. As shown in FIGS. 3 and 4, the cutter blade 37 is oriented in a vertical plane on one end of a horizontal shaft 39, with the shaft 39 being free to rotate within the carriage 19, on the shaft 39 axis.

A conventional one-way overrunning roller-type clutch mechanism 41, is mounted within carriage 19, in surrounding relation to shaft 39. The clutch mechanism 41, exerts a selective clutch force on shaft 39, in order to permit the shaft 39 to rotate in one direction, but to prevent the shaft 39 from rotating in the opposite direction. The impetus for shaft rotation, is the frictional drag between the cutter blade 37 and the workpiece, or corrugated paperboard panel 10. As seen in FIG. 3, the overrunning clutch 41 is positioned, so that shaft 39, can rotate in a counterclockwise direction, as indicated by the arrow. The overrunning clutch 41 prevents the shaft 39 from rotating in a clockwise direction. A cover plate 42, retains the clutch rollers within carriage 19.

Referring now to FIGS. 1 and 3, carriage 19 moves in the arrow 43 direction, to enable cutter blade 37, to perform a cutting operation, or forming an edge on corrugated paperboard panel 10. The carriage 19 moves in the arrow 45 direction, to reset the cutter blade 37 for the next cutting cycle. Cutter blade 37, is in the non-rotating mode when carriage 19 is moving in the arrow 43 direction, whereas, the cutter blade 37 is in the free rotation mode, when carriage 19 is moving in the arrow 45 direction. The lower edge portion of cutter blade 37, extends into blade groove 47 in table surface 13, in order to ensure full penetration of the cutter blade 37 through the entire cross section of corrugated paperboard panel 10.

Figure 6:
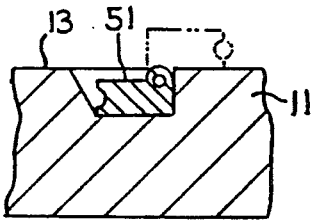
FIG. 6, is an enlarged sectional view, taken along line 6—6, in FIG. 1.

FIG. 6, is an enlarged sectional view, taken along line 6—6, in FIG. 1.

FIGS. 1 and 6, illustrate a very important feature of the present invention. A straight linear steel, or ferromagnetic, reference rod 49 is shown extended through one internal flute of corrugated paperboard panel 10, with its opposite ends exposed. The reference rod 49, preferably has a snug fit within the selected flute, i.e., having minimal play between the reference rod 49 and the panel 10 flute. Two permanent magnets 51, are located on table 11, to grip, or anchor, the exposed ends of reference rod 49, in a location, wherein, the reference rod 49 extends parallel to groove 47, i.e., the cutting plane of cutter blade 37. By attaching reference rod 49 to the magnetic anchorages 51, it is possible to orient the panel corrugations precisely parallel to the cutting plane, even though the flutes, or corrugations, located within panel 10, are not visible.

Reference reference rod 49, is detachable from table 11, so that it can be readily inserted through a selected flute in panel 10, with the panel 10 spaced from table surface 13. The panel 10, does not have to be positioned on table surface 13, when reference rod 49 is inserted through the selected flute. The first cut is performed on paperboard panel 10, with reference rod 49 securely attached to magnet 51 anchorages, as shown in FIG. 1. Because of the reference rod 49 orientation, the first edge cut will be precisely parallel to the panel flutes or corrugations, which is a major aim of the present invention.

Subsequently, the second, third, and fourth edge cuts are made in paperboard panel 10, to form the other three edges of the square, or other rectangular, test specimen, with reference rod 49 removed from paperboard panel 10. Reference rod 49, is used only to properly, or precisely, orient the paperboard panel 10 for the first cut, i.e., to form the first straight edge on the test specimen. Magnetic 51 anchorages, may be pivotably retracted into the table surface 13 during the last three edge cutting operations, as depicted in FIG. 6.

Figure 5:
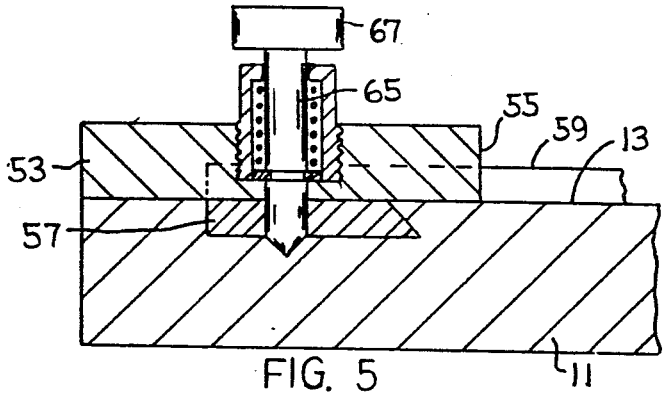
FIG. 5, is a sectional view, taken along line 5—5, in FIG. 1.

FIG. 5, is a sectional view, taken along line 5—5, in FIG. 1.

Referring now to FIGS. 1, 2, and 5, there is shown a plate 53, which is attached to table 11, to form a linear abutment surface 55. As viewed in FIG. 1, abutment surface 55 is oriented at right angles to blade groove 47. The second edge cut is next made with the straight edge of paperboard panel 10, formed by the first edge cut, being engaged against abutment surface 55. This ensures that the second formed edge will be precisely normal to the first formed edge.

A slidably adjustable T-square is also provided to determine the edge length dimensions of the final test specimen. The T-square, includes a slidable guide bar 57, positioned in a linear guide slot into, and below, the surface 13 of table 11. A measuring bar 59, is attached to the upper face of guide bar 57, as at 61, as shown in FIG. 1, so that the measuring bar 59 is resting upon support surface 13. Measuring bar 59, has its measuring edge 62, oriented parallel to blade groove 47, as seen in FIG. 1. Guide bar 57, can be slid back and forth to vary the spacing between measuring bar 59 and blade groove 47, in order to thus precisely determine the size of the square, or other rectangular, test specimen, produced by the precise cutting operations on paperboard panel 10.

Preferably, a series of measuring holes 63 are formed along guide bar 57. A cooperating, spring-biased, plunger means 65, is mounted on plate 53, as shown in FIG. 5, such that when the plunger means 65 is spring-biased downwardly, it snaps into a selected hole 63, which holds the T-square in a selected position of adjustment. A manual lifting force on plunger knob 67, can be used for raising the plunger means 65, in order to permit adjustment of the T-square to a different measuring position of adjustment. Typically, holes 63 are spaced so as to provide a desired range of test specimen sizes, from about one inch along each edge, to about six inches along each edge.

Figure 7:
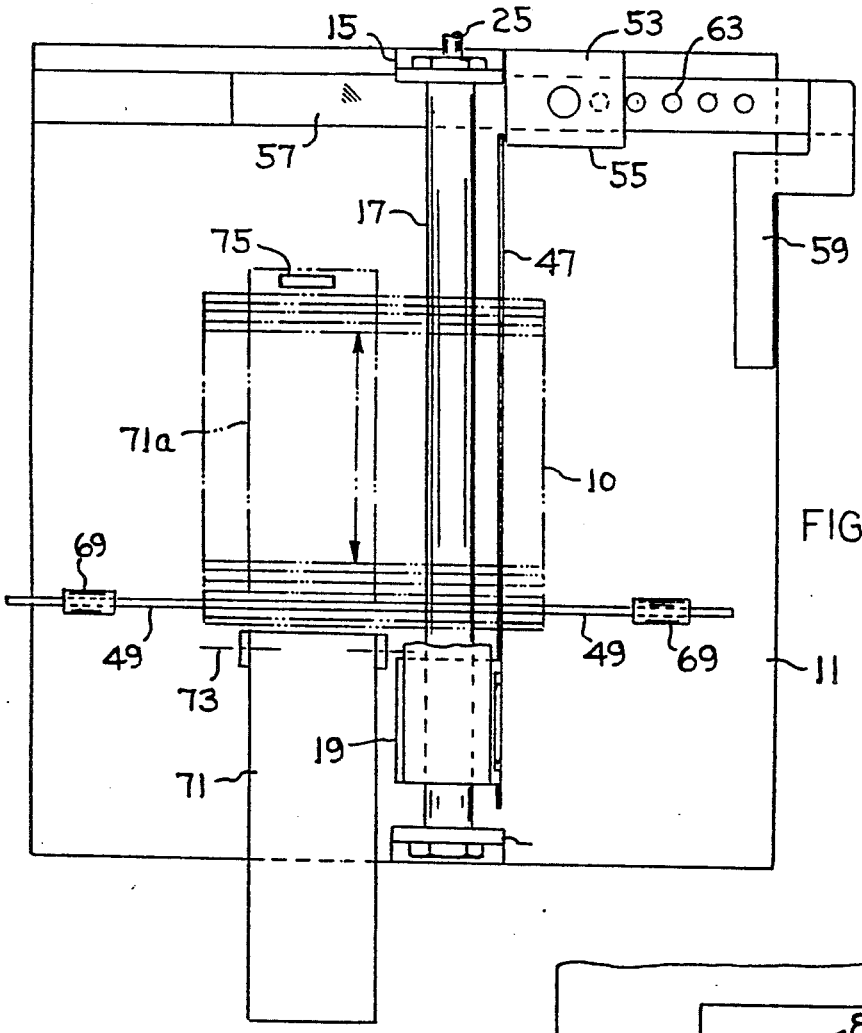
FIG. 7, is a plan view, taken in the same direction as FIG. 1, but illustrating an apparatus being another embodiment of the present invention.

FIG. 7, is a plan view, taken in the same direction as FIG. 1, but illustrating an apparatus being another embodiment of the present invention.

FIG. 7 shows an alternate embodiment of the present invention, wherein the reference rod 49, is anchored in a position extending normal to the cutting plane of cutter blade 37, and parallel to abutment surface 55. In this embodiment, the reference rod 49 anchorage devices, are tubes 69, suitably mounted on the table surface for alignment at right angles to the cutter blade cutting plane, i.e., blade groove 47.

During operation of the apparatus, the reference rod 49 is extending through a selected flute in paperboard panel 10, after which, the projecting ends of the reference rod 49 are extended through the aligned anchorage tubes 69. During this last operation, the corrugated panel 10 should be positioned flatwise on the table 11, in order to facilitate alignment of the reference rod 49 with both anchorage tubes 69.

During the first cut, reference rod 49 cannot extend across blade groove 47, otherwise it will be struck by the cutter blade 37. The reference rod 49, is at least partially removed to a non-obstructing position, but without disturbing the aligned position of paperboard panel 10, on the table surface 13. To ensure that paperboard panel 10 is properly oriented, and secured, on the surface 13 of table 11, while the first cut is being made, a separate clamp mechanism may be applied to the panel. As shown in FIG. 7, the clamp mechanism comprises a flat rigid plate 71, swingably attached to the table 11 for swinging motion around an axis 73. The plate 71 can be swung around axis 73, to a clamping position 71*a*, shown as dashed lines, resting on the upper surface of corrugated paperboard panel 10. A stop device 75, can also be provided to limit the pressure of the plate on paperboard panel 10.

With plate 71, resting, or held against, paperboard panel 10, the panel 10 is prevented from shifting during the first edge cut. As previously noted, reference rod 49 is slid to a non-obstructing position during the cutting cycle. The reference rod 49, is used to ensure a proper initial position of the panel 10. Plate 71 is used to retain the panel securely in its proper position. The remaining three edge cuts on the panel 10 are made without using reference rod 49 or plate 71. In this embodiment, the reference rod 49 and plate 71, are used only at the first edge cut, in order to ensure the desired orientation between the first edge on the test specimen and the flute direction.

In the embodiment of the FIG. 1 apparatus, the first precision edge cut is made parallel to the flute direction, whereas in the embodiment of the FIG. 7 apparatus, the first precision edge cut is made normal to the flute direction. However, either apparatus is useful in the practice of the present invention, since either apparatus produces a precise and specific orientation, between the flutes and the straight cut edges formed on the final square, or other rectangular, test specimen.

Mention was previously made of the fact that cutter blade 37 is selectively rotatable, in order to present different cutter blade edge areas thereof to the work. When carriage 19 is returning the cutter blade 37 to its starting position, as shown in FIGS. 1 and 2, the edge of the cutter blade 37 frictions against the newly-formed edge on paperboard panel 10, thereby rotating the cutter blade 37 to some randomly indeterminate position, that is statistically different than other previous positions. Over time, the cutter blade 37 will have a large range of different starting rotated positions, such that the entire cutter blade circumference is effectively used, even though the cutter blade 37 is in a non-rotating mode, during each cutting cycle.

Figure 8:
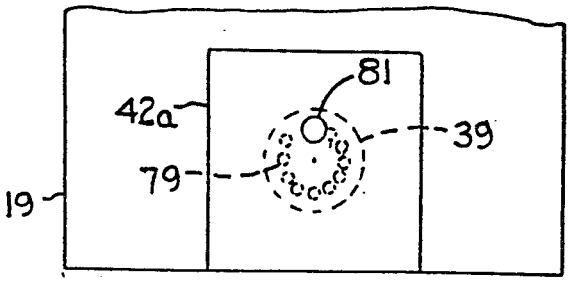
FIG. 8, is an end view, of a shaft lock mechanism, that can be used in practice of the present invention.

FIG. 8 shows another way in which a major portion of the cutter blade circumference can be effectively utilized. In this instance, the cutter blade support shaft 39, has a ring of small holes 79, drilled into its end surface. A spring-urged plunger means 81, similar to the plunger means 65, shown in FIG. 5, is mounted on cover plate 42*a*, for selective engagement with different holes 79. By periodically adjusting the position of the blade support shaft 39, it is thus possible to utilize essentially the entire cutter blade circumference. In the FIG. 8 embodiment, there is no overrunning clutch, and the cutter blade support shaft 39, is non-rotating, during both the forward and return portions of the cutting stroke.

The drawings necessarily show specific forms, features and relationships, useful in particular embodiments of the present invention. However, it will be appreciated that the present invention can be practiced in other ways not explicitly depicted in the drawings. The previous detailed description of the preferred embodiments of the present invention is presented for purposes of clarity of understanding only, and no unnecessary limitations should be understood or implied therefrom, as all appropriate mechanical and functional equivalents to the above, which may be obvious to those skilled in the arts pertaining thereto, are considered to be encompassed within the claims of the present invention.

What is claimed is:

1. A method for precision cutting of corrugated paperboard panel specimens into rectangular shapes of predetermined size, wherein said corrugated specimens have parallel internal flutes extending across the entire specimen face area: said method comprising the steps of extending a linear reference rod through a flute of said specimen so that opposite ends thereof project beyond said specimen's end edges; anchoring the opposite ends of said reference rod at specific points on a table surface, with said specimen lying flat on said surface; moving a cutter means linearly across said table surface, along a predetermined pathline related to the direction taken by said reference rod, whereby said cutter means forms a first straight edge on said specimen; positioning said specimen on said table surface, with said first edge engaged against a linear abutment extending normal to said cutter means pathline; and moving said cutter means a second time to form a second straight edge oriented at a right angle to said first straight edge.

2. The method as described in claim 1, wherein said step of anchoring the ends of said reference rod to said table surface is carried out so that said anchored reference rod is parallel to said cutter means pathline.

3. The method as described in claim 1, wherein said step of anchoring the ends of the reference rod to the table surface is carried out so that said anchored reference rod is normal to said cutter means pathline.

4. The method as described in claim 1, wherein said step of moving said cutter means along said predetermined pathline, is carried out with a vertically-oriented circular cutter blade.

5. The method as described in claim 4, wherein said circular cutter blade is controlled, so that it is in a non-rotating mode while it is forming a straight edge on said specimen, said cutter blade being in a rotating mode while it is being reset for the next edge-forming operation, whereby different unworn edge areas of said cutter blade can be presented to said specimen.

6. An apparatus for precision cutting of corrugated paperboard panel specimens into rectangular shapes of predetermined size, wherein said corrugated specimens have parallel internal flutes extending across the entire specimen face area; said apparatus comprising a table means, defining a flat specimen support surface; a linear abutment means projecting upwardly from said support surface to receive an edge of said specimen when said specimen is lying flat on said support surface; a cutter means mounted for linear motion over said table means on a linear path normal to said abutment means; a reference rod extendable linearly through a flute of said specimen, so that opposite ends thereof project beyond said specimen edges; and anchorage means on said table means for engagement with the projecting ends of said reference rod, whereby said specimen is temporarily supported on said support surface, with its flutes precisely oriented relative to the pathline for said cutter means.

7. The apparatus as described in claim 6, wherein said anchorage means is located on said table means, so that said engaged reference rod is parallel to said pathline for said cutter means.

8. The apparatus as described in claim 6, wherein said anchorage means is located on said table means, so that said engaged reference rod is parallel to said linear abutment means.

9. The apparatus as described in claim 6, wherein said anchorage means comprises two separate anchorage devices, said devices individually engageable with said projecting ends of said reference rod; each said anchorage device being mounted on said table means for movement between an operating position projecting above said specimen support surface and a depressed non-operating position retracted into said table means.

10. The apparatus as described in claim 9, wherein each said anchorage device comprises a magnet.

11. The apparatus as described in claim 6, wherein said cutter means comprises a carriage mounted for linear reciprocating movement over said specimen support surface, and a circular cutter blade oriented in a vertical plane on said carriage, so that said linear movement of said carriage causes an edge of said cutter blade to exert a shearing action on said specimen lying on said specimen support surface.

12. The apparatus as described in claim 11, and further comprising means supporting said circular cutter blade for rotational adjustments around its circular axis, whereby different unworn edge areas of said cutter blade can be presented to the specimen.

13. The apparatus as described in claim 12, wherein said rotational adjustment means comprises a one way overrunning clutch that prevents said circular cutting blade from rotating while said cutter blade is performing a cutting operation on said specimen.

14. The apparatus as described in claim 6, and further comprising a linear guide overrunning said table means to define a guidance axis; said cutter means comprising a carriage slidably mounted on said linear guide for reciprocating movement along said guidance axis, a horizontal rotary shaft extending through said carriage normal to said guidance axis, a circular cutter blade mounted on one end of said shaft so that said cutter blade is in a vertical plane parallel to said guidance axis, and a one-way overrunning clutch mounted in said carriage to exert a one-way clutch action on said shaft, whereby during movement of said carriage in one direction, an edge of said cutter blade cuts into said specimen, while said clutch prevents said cutter blade from rotating, and, during movement of said carriage in the opposite direction, frictional drag of said specimen on said cutter blade causes said cutter blade and said shaft to rotate without interference from said one-way clutch.

* * * * *